United States Patent [19]

Miller et al.

[11] Patent Number: 4,490,587

[45] Date of Patent: Dec. 25, 1984

[54] SWITCH ASSEMBLY

[75] Inventors: Paul H. Miller, Wheaton; Charles D. Stelzner, Hoffman Estates, both of Ill.

[73] Assignee: Microdot Inc., Darien, Conn.

[21] Appl. No.: 482,832

[22] Filed: Apr. 7, 1983

[51] Int. Cl.[3] ..... H01H 13/70

[52] U.S. Cl. ..... 200/5 A; 200/159 B

[58] Field of Search ..... 200/1 R, 5 R, 5 A, 159 B, 200/265, 159 R, 302.1, 308, 340, 86 R; 339/17 CF, 17 R, 59 M; 174/110 R

[56] References Cited

U.S. PATENT DOCUMENTS

| | | | |
|---|---|---|---|
| 3,699,294 | 10/1972 | Sudduth | 200/86 R X |
| 3,728,509 | 4/1973 | Shimojo | 200/159 B |
| 3,898,421 | 8/1975 | Suzumura | 200/159 B |
| 3,932,722 | 1/1976 | Obata et al. | 200/5 A X |
| 4,289,940 | 9/1981 | Sado et al. | 200/5 A |
| 4,317,011 | 2/1982 | Mazurk | 200/5 A |
| 4,390,765 | 6/1983 | Sado et al. | 200/159 B |
| 4,435,796 | 3/1984 | Saito et al. | 200/5 A X |

FOREIGN PATENT DOCUMENTS

| | | | |
|---|---|---|---|
| 3033134 | 5/1981 | Fed. Rep. of Germany | 200/159 B |
| 2054268A | 2/1981 | United Kingdom | 200/159 B |
| 2055510A | 3/1981 | United Kingdom | 200/159 B |
| 2100517A | 12/1982 | United Kingdom | 200/159 B |

*Primary Examiner*—J. R. Scott

*Attorney, Agent, or Firm*—Lyman R. Lyon

[57] ABSTRACT

A switch assembly comprising a flexible face cover membrane; a flexible keyboard membrane positioned immediately below the face cover membrane and including a base portion and a plurality of raised hollow contact pad portions projecting upwardly from the base portion through openings in the face cover member; a flexible printed circuit board membrane positioned below the keyboard membrane for switching coaction with the contact pad portions of the keyboard membrane; and adhesive means bonding the membranes together into a thin, flexible sealed switch sandwich. In one embodiment of the invention, the keyboard membrane is formed of a non-conductive elastomeric material and conductive elastomeric buttons are secured to the underside of the contact pad portions of the keyboard membrane for coaction with printed circuitry on the upper surface of the circuit board membrane.

1 Claim, 5 Drawing Figures

SWITCH ASSEMBLY

BACKGROUND OF THE INVENTION

This invention relates to switch assemblies. More particularly, it relates to switches for use in providing singals for use by solid state electronic logic circuitry devices. These switches typically have a sandwich or laminar construction and include a keyboard layer and one or more printed circuit board layers which coact with the keyboard to provide the switching signals. While switches of this type are available in a myriad of forms, and while they are generally satisfactory in providing the desired signals for use by the solid state logic devices, they are limited in their applications. Specifically, prior art switches either embody some degree of structural rigidity which inhibits the environments in which they can be mounted; or they are not totally sealed with a resultant limitation on application environments; or they fail to provide a positive tactile contact signal to the operator with the result that they cannot be used in the many environments in which such a positive tactile signal is essential.

SUMMARY OF THE INVENTION

The present invention provides a switch assembly which is extremely flexible, is totally sealed, and provides a positive tactile contact signal.

The invention switch assembly includes a flexible face cover membrane; a flexible keyboard membrane positioned immediately below the face cover membrane and including a plurality of raised hollow contact pad portions projecting upwardly through openings in the face cover membrane; a flexible printed circuit board membrane positioned below the keyboard membrane for switching coaction with the contact pad portions of the keyboard membrane; and adhesive means bonding the membranes together into a thin flexible sealed switch sandwich. The described construction provides a switch assembly which is extremely thin and flexible, allowing mounting on even irregular mounting surfaces, which is totally sealed, allowing usage in even hostile environments, and which provides a positive tactile contact signal to the operator, allowing usage in the many environments in which such a signal is essential.

According to a further feature of the invention, an adhesive layer is provided on the under surface of the circuit board membrane to facilitate adhesive mounting of the switch to a suitable mounting surface. This adhesive layer, which may be protected prior to mounting by a removable treated paper membrane, coacts with the thinness and flexibility of the switch to allow the switch to be readily and effectively mounted on almost any conceivable mounting surface.

In one embodiment of the invention, the keyboard membrane is formed of a non-conductive elastomeric material and conductive elastomeric buttons are secured to the underside of each contact pad portion for coaction with printed circuitry on the upper surface of the circuit board membrane.

In another embodiment of the invention, the switch further includes a second flexible printed circuit board membrane which is adhesively bonded at its upper surface to the under surface of the first keyboard membrane, and a flexible spacer membrane, having a plurality of openings therein, is adhesively sandwiched between the two printed circuit board membranes with its openings in vertical alignment with the openings in the face cover membrane so that the spacer membrane normally maintains separation between confronting printed circuitry on the two printed circuit board membranes but allows the confronting printed circuitry to switchingly coact in response to downward deflection of the upper printed circuit board membrane upon depression of the overlying contact pad portion.

In both of the disclosed embodiments of the invention, each contact pad portion has a mesa configuration and is connected to the base portion of the keyboard membrane by sloping walls which are configured to allow the contact pad to move downwardly with a toggle action to transmit a positive tactile contact signal to the operator.

DETAILED DESCRIPTION OF THE PREFERRED EMBODIMENTS OF THE INVENTION

Figure 1:
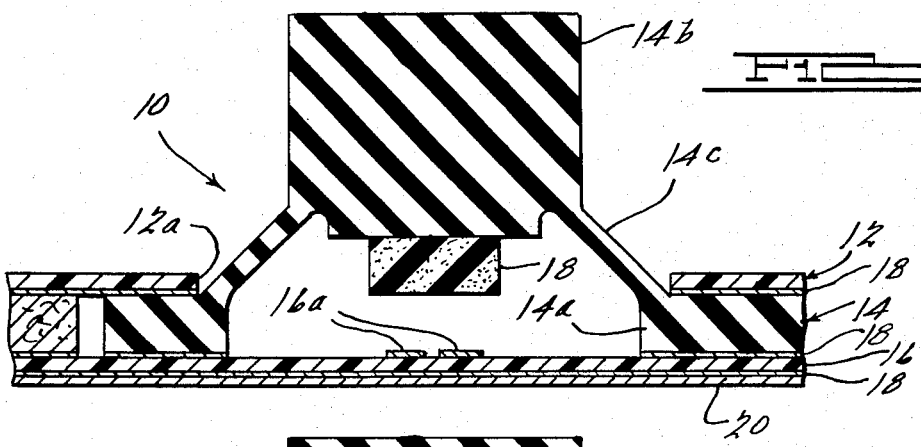
FIGS. 1 and 2 are cross sectional views of one embodiment of the invention switch assembly shown, respectively, in its inoperative or non-signal transmitting disposition and in its operative or signal transmitting disposition.
Figure 2:
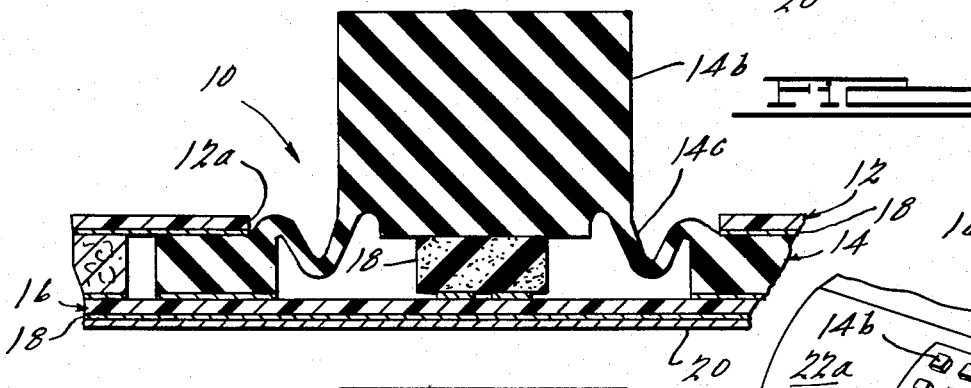

Switch assembly embodiment 10 seen in FIGS. 1 and 2 includes a face cover membrane 12, a contact pad membrane 14, and a circuit board membrane 16.

Face cover membrane 12 comprises a thin flexible sheet or film having a plurality of regularly spaced openings **12*a* therein. Membrane 12** may comprise, for example, a polyester or a polyether film having a thickness of approximately 0.015 inches.

Keyboard membrane 14 includes a base portion **14*a*, positioned immediately beneath face cover membrane 12, and a plurality of regularly spaced raised hollow contact pad portions 14*b* projecting upwardly from base portion 14*a* through the respective openings 12*a* in the face cover membrane. Each contact pad portion 14*b* has a mesa configuration and is connected to base portion 14*a* by sloping side walls 14*c*. A conductive button 18 is secured to the underside of each contact pad portion 14*b*. Keyboard membrane 14 may be formed of a di methyl vinyl silicone filled with common fillers and may have a base portion thickness of 0.040 inches and a pad portion height, as measured from the upper surface of the base portion, of 0.175 inches. Conductive button 10 may be formed of a di methyl vinyl silicone filled with acetylene black. Further details with respect to the materials of contact pad 14 and conductive buttons 10**, as well as a preferred process and apparatus for bonding the buttons to the contact pad portions, are disclosed in U.S. Pat. Application Ser. No. 482,833, filed Apr. 7, 1983, and assigned to the assignee of this application.

Printed circuit board membrane 16 immediately underlies base portion **14*a* of keyboard membrane 14 and preferably comprises a thin sheet of polyester or polyether film having printed circuitry 16***a* on its upper face in the form of conductive carbon or silver ink. Membrane 16 may, for example, have a thickness of approximately 0.020 inches.

Membranes 12, 14 and 16 are securely bonded together into a thin flexible sealed switch sandwich by adhesive means 18. Adhesive means 18 preferably comprises an acrylic latex pressure sensitive adhesive with each adhesive layer in the final sandwich having a thickness of approximately 0.004 inches. The resulting sandwich of membranes 12, 14 and 16 is extremely thin (for example, 0.083 inches including the adhesive layers but excluding the height of pad portions 14*b*) and extremely flexible.

A further layer of adhesive 18 is provided on the under surface of printed circuit board membrane 16 for convenience in attaching the switch assembly to a mounting surface. Preferably, a silicone treated paper laminate 20 is provided to protect the adhesive mounting layer prior to mounting. Laminate 20, by virtue of its silicone treatment, may be readily removed prior to mounting. The layer of adhesive 18 on the under surface of circuit board membrane 16 may have a thickness of approximately 0.003 inches and laminate 20 may have a thickness of approximately 0.004 inches.

Figure 5:
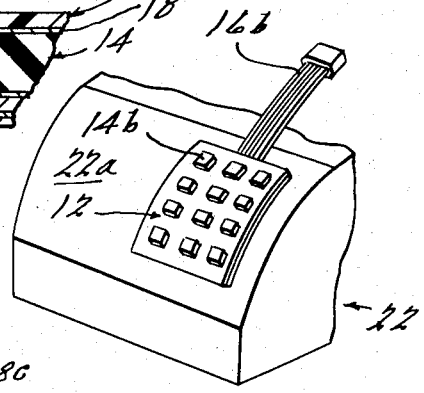
FIG. 5 is a fragmentary perspective view showing an invention switch assembly mounted to an irregular mounting surface on a solid state electronic logic circuitry device.

In the operation of the switch assembly of FIGS. 1 and 2, downward pressure on a contact pad portion 14*b* will cause the contact pad to move downwardly with a toggle action, as seen in FIG. 2, to allow conductive button 10 to coact with printed circuitry 16*a* to transmit an electrical signal to an associated electronic logic circuitry device through a standard tail connection 16*b* (FIG. 5) formed as an extension of circuit board membrane 16.

The construction of FIGS. 1 and 2 will be seen to provide a switch assembly that is extremely thin and flexible, allowing mounting on even irregular mounting surfaces such as the curved facia 22*a* of the electronic circuit device 22; that is totally sealed from moisture and other contaminants so as to allow its use in even extremely hostile environments; and that provides a positive tactile contact signal to the operator by virtue of the positive toggle snap of contact pads 14*b* as they move to their operative position. And the adhesive layer on the underside of circuit board membrane 16 facilitates ready, quick and positive mounting of the switch assembly on virtually any desired mounting surface.

Figure 3:
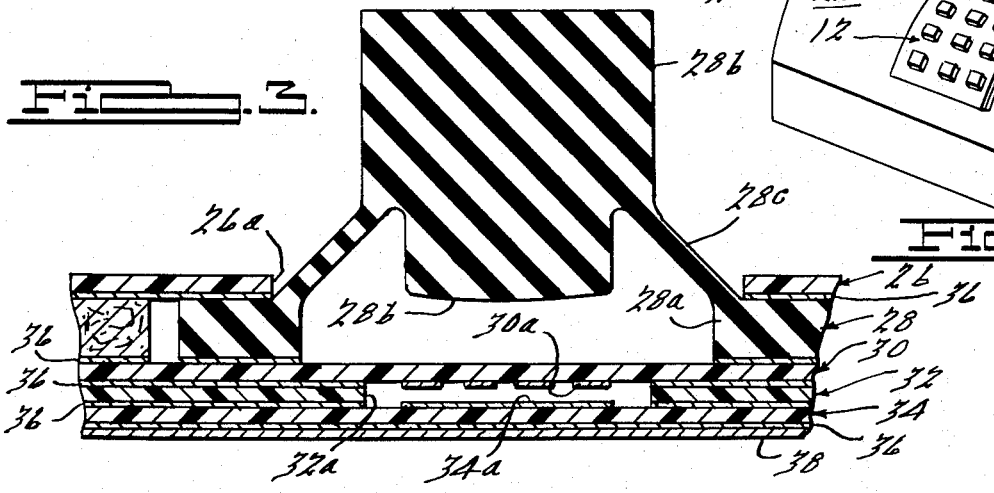
FIGS. 3 and 4 are cross sectional view of another embodiment of the invention switch assembly shown, respectively, in its inoperative or non-signal transmitting disposition and in its operative or signal transmitting disposition.
Figure 4:
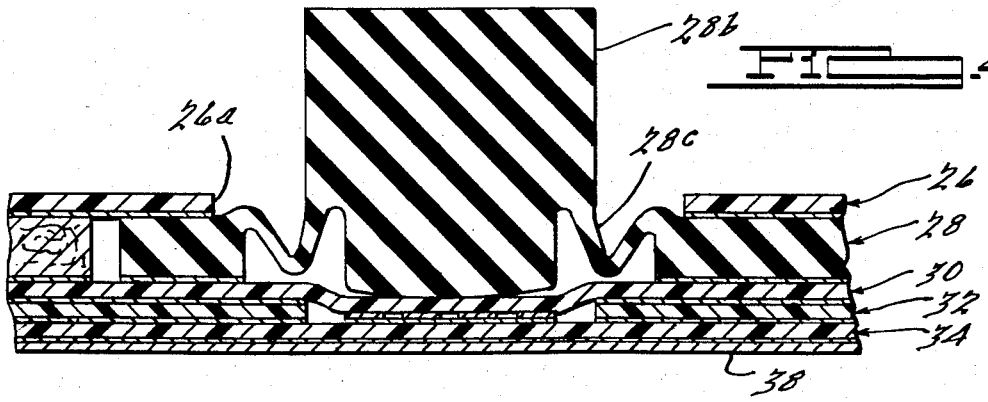

The switch assembly embodiment 24 as seen in FIGS. 3 and 4 includes a face cover membrane 26, a keyboard membrane 28, a first or upper printed circuit board membrane 30, a spacer membrane 32, and a second or lower printed circuit board membrane 34.

Face cover membrane 26 includes regularly spaced openings 26*a* and is identical in all respects to the face cover membrane 12 of the FIGS. 1 and 2 embodiment.

Keyboard membrane 28 is identical to the keyboard membrane of the FIGS. 1 and 2 embodiment with the exception that contact button 18 is eliminated and the under surface of each contact pad portion 28*b* is built up to provide an actuator portion 28*d* for coaction with the underlying circuit board membranes.

Circuit board membranes 30 and 34 may comprise thin sheets (for example 0.020 inches) of polyester or polyether film having printed circuitry 30*a* on the under surface of membrane 30 and coacting printed circuitry 34*a* on the upper surface of membrane 34. The printed circuitry in each case may be in the form of conductive carbon or silver ink.

Spacer membrane 32 may comprise a thin sheet (for example 0.010 inches) of polyester or polyether film having regularly spaced openings 32*a* registering with the openings 26*a* in the face cover membrane and with the locations of the printed circuitry 30*a* and 34*a* on the circuit board membranes.

Membranes 26, 28, 30, 32 and 34 are securely bonded together into a thin flexible sealed switch sandwich by adhesive means 36. Adhesive means 36 preferably comprise an acrylic latex pressure sensitive adhesive with each adhesive layer in the final sandwich having a thickness of approximately 0.004 inches.

The resulting sandwich of membranes 26, 28, 30, 32 and 34 is extremely thin (for example 0.121 inches including the adhesive layers but excluding the height of pad portions 28*b*) and extremely flexible.

A further layer of adhesive 36 (for example 0.003 inches) is provided on the under surface of lower circuit board membrane 34 for convenience in attaching the switch assembly to the mounting surface and a silicone treated paper laminate 38 (for example 0.004 inches) is provided to protect the adhesive mounting layer prior to mounting.

In the operation of the switch assembly of FIGS. 3 and 4, downward pressure on contact pad portions 28*b* will cause the contact pad to move downwardly with a toggle action, as seen in FIG. 4, to allow pad actuator portion 28*d* to deflect upper circuit board membrane 30 downwardly and bring printed circuitry 30*a* into switching coaction with printed circuitry 34*a* on lower circuit board membrane 34 to transmit an electrical signal to an associated electronic logic device through a standard tail connection formed as an extension of upper circuit board membrane 30.

As with the switch assembly of the FIGS. 1 and 2 embodiment, the switch assembly construction of the FIGS. 3 and 4 embodiment provides a switch assembly that is extremely thin and flexible for ease and universality of mounting; that is totally sealed so as to allow its use in even extremely hostile environments; and that provides a positive tactile contact signal to the operator. And, as with the FIGS. 1 and 2 embodiment, the adhesive layer 36 on the under surface of the lower circuit board membrane facilitates ready, quick and positive mounting of the switch assembly on virtually any desired mounting surface.

As between the two disclosed embodiments, the FIGS. 1 and 2 embodiment is preferable in applications where extreme thinness and flexibility is paramount, while the FIGS. 3 and 4 embodiment is preferable in applications where absolute sealing from all hostile environments is paramount. Both embodiments provide a switch assembly which is virtually universally mountable, offers excellent sealing characteristics, and provides a positive tactile contact signal.

While preferred embodiments of the invention have been illustrated and described in detail, it will be apparent that various changes may be made in the disclosed embodiments without departing from the scope or spirit of the invention.

We claim:

1. A flexible switch assembly for providing a signal for use by solid state electronic logic circuitry, said switch comprising:

A. a flexible face cover membrane having a plurality of openings therein;

B. a flexible keyboard membrane positioned immediately below the face cover membrane and including a base portion and a plurality of raised hollow contact pad portions projecting upwardly from the base portion through the respective openings in the face cover membrane;

C. a flexible printed circuit board membrane positioned below the keyboard membrane for switching coaction with said contact pad portions;

D. adhesive means bonding said membranes together into a thin, flexible, sealed switch sandwich;

E. said keyboard membrane being formed of a nonconductive ellastomeric material; and F. a plurality of conductive elastomeric buttons secured to the underside of each contact pad portion, respectively, for coaction with printed circuitry on the upper surface of the circuit board membrane, said buttons being normally disposed in the plane of said cover membrane within the openings therein and movable out of said plane into contact with said printed circuit board membrane, each contact pad portion having a mesa configuration and connected to the base portion of the keyboard membrane by sloping walls which are configured to allow the contact pad portion to move downwardly through the opening in said face cover membrane with a toggle action to transmit a positive tactile contact signal to the operator.

* * * * *